US005162816A

United States Patent [19]

Yorozu

[11] Patent Number: 5,162,816

[45] Date of Patent: Nov. 10, 1992

[54] METHOD FOR SETTING COLOR OF COLOR INK RIBBON IN THERMAL TRANSFER PRINTER

[75] Inventor: Hideki Yorozu, Iwate, Japan

[73] Assignee: Alps Electric Co., Ltd., Tokyo, Japan

[21] Appl. No.: 558,289

[22] Filed: Jul. 26, 1990

[30] Foreign Application Priority Data

Jul. 26, 1989 [JP] Japan ..... 1-193702

[51] Int. Cl.[5] ..... B41J 33/14

[52] U.S. Cl. ..... 346/76 PH; 400/232; 400/237 E

[58] Field of Search ..... 400/223, 225, 236, 236.2, 400/120, 240, 240.3, 240.4, 237, 237 E; 366/76 PH, 1.1

[56] References Cited

U.S. PATENT DOCUMENTS 4,620,199 10/1986 Tatsumi et al. ..... 346/76 PH

FOREIGN PATENT DOCUMENTS 0008186 1/1982 Japan ..... 400/237 E
0180883 9/1985 Japan .
0215084 9/1986 Japan .
0134284 6/1987 Japan .
0267086 10/1989 Japan .
2228449A 8/1990 United Kingdom .

*Primary Examiner*—Benjamin R. Fuller
*Assistant Examiner*—Huan Tran
*Attorney, Agent, or Firm*—Guy W. Shoup; B. Noel Kivlin

[57] ABSTRACT

The present invention relates to a method for setting a desired color in a thermal transfer printer using a color ink ribbon which has ink sections of plural colors arranged in continuous repeating units in the longitudinal direction of the ink ribbon. Taking note of the fact that in a short distance from a color detecting sensor up to a printing position, the amount of the ribbon wound up for a rotational amount corresponding to one step of a ribbon winding motor is almost constant, irrespective of the amount of the ink ribbon used, the present invention was accomplished. According to the present invention, the number of steps of the motor for feeding a color distinguishing marker on the ink ribbon is counted by a sensor and the ribbon is fed from the position of the said sensor up to the printing position by a predetermined integer multiple of steps of the counted value, whereby a desired color is set in the printer accurately.

3 Claims, 2 Drawing Sheets

METHOD FOR SETTING COLOR OF COLOR INK RIBBON IN THERMAL TRANSFER PRINTER

BACKGROUND OF THE INVENTION

1. Field of the Invention

The present invention relates to a thermal transfer printer and more particularly to a method for setting a desired color of a color ink ribbon in a thermal transfer printer.

2. Description of the Prior Art

FIG. 3 illustrates a conventional printer in which a flat plate-like platen 2 is disposed nearly centrally on a frame 1 of the printer so as to be approximately perpendicular to a printing surface. A carriage shaft 3 is disposed in parallel with the platen 2 in a lower position in front of the platen 2 of the frame 1. The front edge of the frame 1 is formed with a flange-like guide portion 4, and on the carriage shaft 3 and the guide portion 4 there is mounted a carriage 5 reciprocably movable along the carriage shaft 3 and the guide portion 4. To the front end of the carriage 5 is attached a printing head 6 in an opposed relation to the platen 2. A ribbon cassette (not shown) which contains an ink ribbon and which guides the ink ribbon to the space between the printing head 6 and the platen 2 is to be loaded onto the upper surface of the carriage 5.

In addition, a winding mechanism 7 is disposed in the carriage 5. The winding mechanism 7 has a winding shaft 8, as shown in FIGS. 4 and 5. The lower end of the winding shaft 8 is integrally formed with an externally projecting support flange 9, and a winding gear 10 is loosely fitted on the lower end portion of the winding shaft 8 so as to be rotatable independently of the winding shaft. Felt 11, serving as a slip mechanism, is interposed between the underside of the winding gear 10 and the support flange 9 of the winding shaft 8. Further, a winding bobbin 12 is fixed onto the upper end portion of the winding shaft 8 so that it is exposed from the upper surface of the carriage 5 for engagement with a winding hole (not shown) of the ribbon cassette. From the outer peripheral surface of the winding bobbin 12 there are projected three engaging pawls 13 in circumferentially trisected positions. In the underside of the winding bobbin 12 there is formed an annular retaining slot 14. On the outer peripheral side of the winding shaft 8 there is disposed a spring 15 whose upper end is retained in the retaining slot 14 of the winding bobbin 12 and whose lower end is in abutment with the upper surface of the winding gear 10. By virtue of the spring 15, the winding gear 10 is brought into pressure contact with the support flange 9 of the winding shaft 8 through the felt 11.

Meshing with the winding gear 10 is a driving gear 18 fixed onto a rotary shaft 17 of a ribbon winding motor 16. The driving gear 18 is rotated by the ribbon winding motor 16 to rotate the winding gear 10, so that this rotative driving force is transmitted to the winding shaft 8 by a frictional force of the felt 11 created by virtue of the spring 15 on the winding gear 10.

Behind the platen 2 there is formed a paper inlet 19 for feeding paper (not shown) forwardly of the platen 2. In the paper inlet 19 portion there are disposed paper feed rollers 20 for feeding the paper at a predetermined speed, and under the paper feed rollers 20 there are rotatably disposed pressure rollers 21 in pressure contact with the feed rollers 20. The paper inserted from the paper inlet 19 is conveyed while being sandwiched between the feed rollers 20 and the pressure rollers 21.

In the above conventional printer, paper is inserted from the paper inlet 19 and sandwiched between the paper feed rollers 20 and the pressure rollers 21. Rollers 20 are rotated by the stepping motor to feed the paper at a predetermined speed in a direction perpendicular to the moving direction of the carriage 5. At the same time, the carriage 5 is driven and the ribbon winding motor 16 is also driven to rotate the winding shaft 8 through the winding gear 10, whereby the winding bobbin 12 is rotated to wind up an ink ribbon from the ink ribbon cassette. In this condition, the printing head 6 is driven in accordance with a desired print signal to make a desired printing for the paper.

In the case where a multi-color ink ribbon of plural colors is used as the ink ribbon contained in the ribbon cassette, markers 23 of different longitudinal sizes are provided at boundary portions of the colors, e.g. yellow (Y), magenta (M) and cyan (C), of the ink ribbon indicated at 22, as shown in FIG. 6. The colors of the ink ribbon 22 are detected by reading the markers 23 while winding up the ink ribbon 22 under operation of the ribbon winding motor 16 and hence rotating of the winding bobbin 12 in the same manner as in the foregoing ink ribbon winding operation.

Upon detection of a desired color, the ribbon winding motor 16 is further driven to feed the ribbon so that the desired color reaches a position opposed to a printing position.

In the above conventional color ribbon searching method, however, the diameter of the ribbon on the winding bobbin 7 side becomes different from the original diameter (becomes larger) as the ink ribbon is used, so the amount of the ink ribbon wound up also becomes different even if the winding motor 16 is rotated by the same amount (the same number of steps). More particularly, the amount of ribbon fed from the position of a ribbon color detecting sensor becomes different as the ribbon is used. It is therefore necessary to preset the amount of rotation of the winding motor 16 to wind up the ink ribbon such that a desired color is sure to be opposed to the printing position in a less woundup state on the winding bobbin 7 side (that is, at the beginning of use of the ink ribbon). Where such setting is made, however, the amount of the ink ribbon becomes large even in a somewhat used state of the ribbon and thus the ribbon is wasted. This amount of ink ribbon wasted increases in with increase the winding-side diameter of the ribbon. In order to eliminate such waste of the ribbon, there has been proposed a method in which the head 6 is pressed against the platen as in the ordinary printing, and then the ribbon is drawn out by utilizing the pressing force of the head and is fed by the same distance as the amount of movement of the carriage 5 (head) by utilizing the slip mechanism of the winding bobbin. According to this method, however, it is necessary to move the carriage 5 even when printing is not performed, and thus takes time for feeding the ribbon.

SUMMARY OF THE INVENTION

The present invention has been accomplished for overcoming the above-mentioned problems. According to the present invention there is provided a method for setting a desired color of a color ink ribbon in a thermal transfer printer using an elongated color ink ribbon having ink sections of plural colors arranged in continuous repeating units in the longitudinal direction of the ribbon and with marker portions indicative of the colors being each formed between color sections, the method comprising detecting the length of the marker portion of a desired color by a sensor and feeding the ribbon by a distance corresponding to a predetermined multiple of the detected marker length to set the desired color in the printing portion.

The above means operates as follows. When there is only a short distance from the sensor to the printing position, irrespective of whether the ribbon diameter is large or small, it can be assumed that the amount of the ribbon wound up for each step rotation of the winding motor for the short distance is almost constant. Therefore, if the length of each color distinguishing marker of the ribbon is made constant and the number of steps for feeding the marker, the marker is sensed can be fed from the sensor position to the printing position by feeding the ribbon by a predetermined integer multiple of steps.

DETAILED DESCRIPTION OF A PREFERRED EMBODIMENT

An embodiment of the present invention will be described in detail hereinunder with reference to the accompanying drawings.

Figure 1:
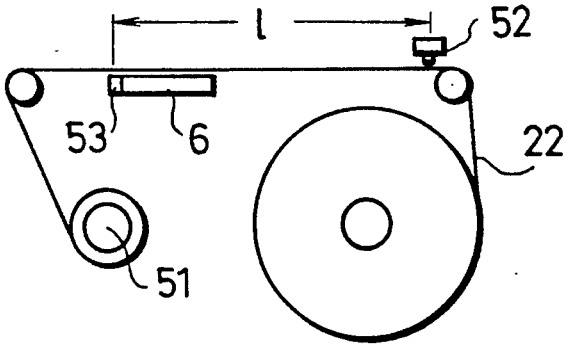
FIGS. 1 and 2 are schematic construction diagrams of a thermal transfer printer according to an embodiment of the present invention.
Figure 2:
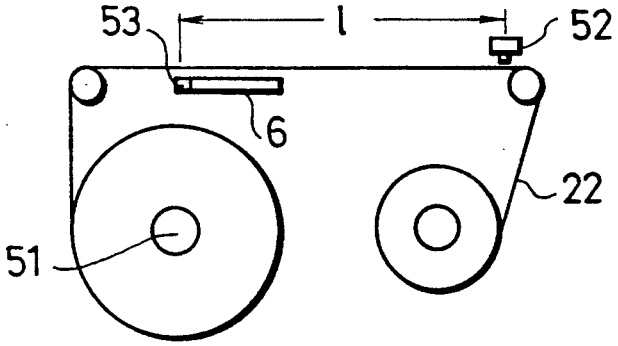
Figure 3:
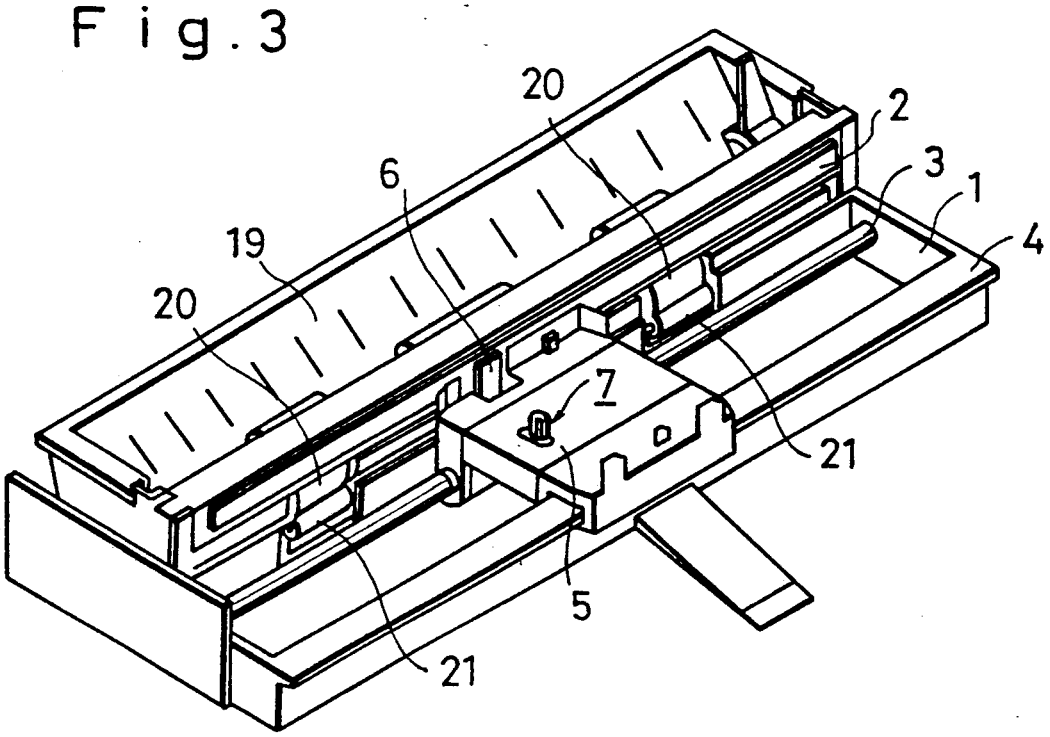
FIG. 3 is a perspective view showing a conventional thermal transfer printer.
Figure 4:
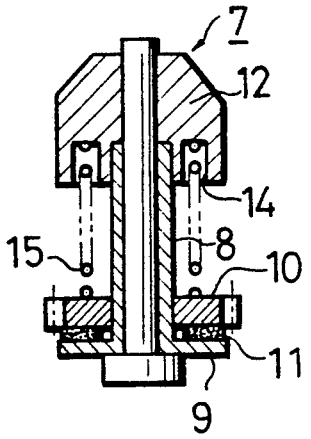
Fig. 4 PRIOR ART
FIG. 4 is a longitudinal sectional view of a winding shaft portion of a conventional winding mechanism.
Figure 5:
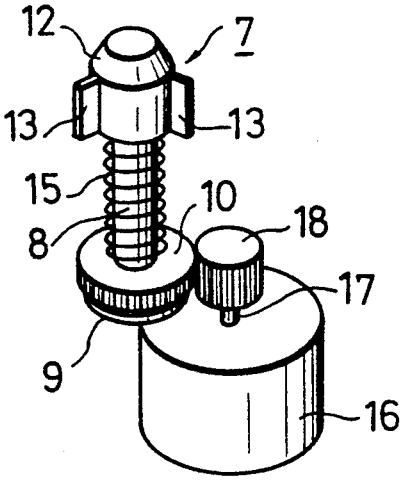
Fig. 5 PRIOR ART
FIG. 5 is a perspective view of the conventional winding mechanism.
Figure 6:
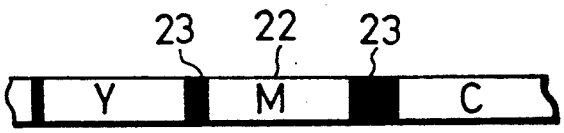
FIG. 6 is an explanatory view showing an ink ribbon with color distinguishing markers formed thereon.

FIGS. 1 and 2 are schematic construction diagrams of a thermal transfer printer embodying the present invention, of which FIG. 1 shows a state of the printer at the beginning of use of an ink ribbon (wound up little on the winding side), while FIG. 2 shows a somewhat-used state of the ink ribbon (wound up much on the winding side).

As is apparent from the figures, between the state in which the ribbon has been wound up by a bobbin 51 like FIG. 1 and the state in which the ribbon has been wound up like FIG. 2, there occurs a difference in the amount of the ribbon wound up even when both bobbins 51 are rotated by the same amount.

In the present invention, the distance between a sensor 52 and a printing position 53 is always constant and relatively short (about 100 mm at most), such that when the ribbon is fed from the sensor position to the printing position, the feed speed is almost constant without great influence on the ribbon diameter on the winding bobbin 51 side. The length of each color distinguishing marker is constant and, in addition, the ratio of the distance (l) between the sensor 52 and the printing position 53 to the length of the marker 23 is always constant. Thus if this ratio is determined and memorized in advance, the ribbon can be fed by an exact distance by feeding the marker by an integer multiple (a value obtained from the ratio) of the number of rotational steps of the motor in accordance with the length of the marker as detected with the sensor 51.

It should be noted that although the feed distance of the marker 23 per step of the motor differs depending on the winding diameter of the ribbon, the length of each marker 23 is detected repeatedly at a certain predetermined distance for each color. Once the marker 23 of a reference color is detected, it is easy to judge the color of the succeeding marker 23. For example, with black color as a reference color, there may be programmed a sequence for detecting a marker of black color.

In FIG. 1 or FIG. 2, the length of the marker 23 is read by the sensor 52. In other words, the number of steps of the winding motor during which the sensor is ON for which the marker corresponds is detected. For example, if the distance l is 100 mm and the length of a yellow marker is 5 mm, then when the number of steps of the winding motor was 20 at the time of detection of the marker, this color portion of the ribbon can be fed to the printing position by rotating the motor 400 steps ($100/5 \times 20 = 400$). If necessary, such number of steps may be set with some margin. Also as to the other colors, they can be set accurately in the same manner as above because the respective markers are constant in length.

According to the present invention, as set forth above, each color ink layer can be fed to a position opposed to the printing position positively without waste by a simple mechanism. This is an outstanding effect.

What is claimed is:

1. A method for setting a desired color of a color ink ribbon in a thermal transfer printer using an elongated color ink ribbon having ink sections wherein a plurality of color sections are arranged in continuous repeating units in a longitudinal direction of the ribbon and with marker portions having different lengths indicative of the colors being each formed between the color sections, wherein a marker portion corresponding to a known desired color is positioned at a sensor, said method comprising the steps of:

detecting a length of the marker portion of a desired color by said sensor, and feeding the ribbon by a distance corresponding to a predetermined multiple of the detected marker length to set the known desired color in a printing position.

2. The method as recited in claim 1 further comprising the steps of:

pre-storing a plurality of ratios of the lengths of the marker portions corresponding to different colors and a distance between said sensor and said printing position; and selecting one of said plurality of ratios which corresponds to the known desired color, wherein the predetermined multiple corresponds to said one of said plurality of ratios.

3. A method for setting a desired color of a color ink ribbon in a thermal transfer printer using an elongated color ink ribbon having ink sections wherein a plurality of color sections are arranged in continuous repeating units in a longitudinal direction of the ribbon and with marker portions having different lengths indicative of the colors being each formed between the color sections, wherein a marker portion corresponding to a known desired color is positioned at a sensor, said method comprising the steps of:

pre-storing a plurality of ratios of the lengths of the marker portions corresponding to different colors and a distance between said sensor and a printing portion;

counting a number of rotative steps of a ribbon winding motor between a moment at which a leading edge of a marker portion passes said sensor until a moment at which a trailing edge of said marker portion passes said sensor;

selecting one of said plurality of ratios which corresponds to the known desired color; and driving said ribbon winding motor by a number of steps which is a product of said number of rotative steps from the leading edge to the trailing edge of said marker portion and a predetermined multiple which corresponds to said one of said plurality of ratios.

* * * * *